US007059304B2

(12) United States Patent
Manzone et al.

(10) Patent No.: US 7,059,304 B2
(45) Date of Patent: Jun. 13, 2006

(54) DRIVE DEVICE FOR ELECTRICAL INJECTORS OF AN INTERNAL COMBUSTION ENGINE COMMON RAIL FUEL INJECTION SYSTEM

(75) Inventors: Alberto Manzone, Alba (IT); Paolo Santero, Orbassano (IT); Riccardo Groppo, Roletto (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/994,184

(22) Filed: Nov. 22, 2004

(65) Prior Publication Data

US 2005/0126543 A1 Jun. 16, 2005

(30) Foreign Application Priority Data

Nov. 25, 2003 (IT) ..... TO2003A0940

(51) Int. Cl.
*F02M 51/00* (2006.01)

(52) U.S. Cl. ..... 123/490; 123/478; 123/480

(58) Field of Classification Search ..... 123/478, 123/480, 490

See application file for complete search history.

(56) References Cited

U.S. PATENT DOCUMENTS

| | | | | |
|---|---|---|---|---|
| 5,717,562 | A | 2/1998 | Antone et al. | |
| 6,173,700 | B1 * | 1/2001 | Yamashita et al. | 123/490 |
| 6,360,725 | B1 * | 3/2002 | Scherrbacher | 123/490 |
| 6,539,925 | B1 * | 4/2003 | Rueger et al. | 123/490 |
| 6,684,862 | B1 * | 2/2004 | Oyama et al. | 123/490 |
| 2003/0195692 | A1 | 10/2003 | Stevens | |

FOREIGN PATENT DOCUMENTS

| | | | |
|---|---|---|---|
| DE | 198 26 037 | A1 | 12/1999 |
| DE | 101 47 484 | A1 | 4/2003 |
| EP | 0 518 239 | A1 | 12/1992 |
| EP | 1 069 299 | A1 | 1/2001 |
| EP | 1 096 114 | A2 | 5/2001 |
| EP | 1 139 448 | A1 | 10/2001 |
| EP | 1 424 478 | A1 | 6/2004 |
| JP | 60040761 | | 3/1985 |

* cited by examiner

*Primary Examiner*—Erick Solis
(74) *Attorney, Agent, or Firm*—Berenato, White & Stavish LLC

(57) ABSTRACT

A drive device for electrical injectors of a common rail fuel injection system of an internal combustion engine has a power circuit, in turn having a drive circuit, for each electrical injector, with a number of switches controlled selectively to regulate the current flowing through the electrical injector; and a control circuit for controlling operation of the power circuit; the control circuit having a number of control modules, each for selectively controlling the switches of a respective drive circuit, and for supplying a state signal ($S_{FLAG}$) indicating the operating state of the control module; and a synchronization module for receiving and processing the state signals ($S_{FLAG}$) to generate a common synchronization signal ($S_{SINC}$) for synchronizing the control modules; each control module synchronizing and coordinating, as a function of the synchronization signal ($S_{SINC}$), the drive actions imparted to the switches of the respective drive circuit, with the drive actions imparted by the other control modules to the corresponding switches.

16 Claims, 5 Drawing Sheets

DRIVE DEVICE FOR ELECTRICAL INJECTORS OF AN INTERNAL COMBUSTION ENGINE COMMON RAIL FUEL INJECTION SYSTEM

BACKGROUND OF THE INVENTION

1. Field of the Invention

The present invention relates to a drive device for electrical injectors of an internal combustion engine common rail fuel injection system.

In particular, the present invention is advantageously, but not exclusively, used for driving electrical injectors of a fuel injection system for a motor vehicle internal combustion engine, in particular for a common rail fuel injection system for a diesel engine, to which the following explanation will make explicit reference, without consequently restricting the general scope thereof.

The device according to the invention, however, also applies to other types of engines, such as petrol, methane or LGP engines.

2. Description of the Related Art

As is known, it is conventional when driving the electrical injectors of a common rail fuel injection system to supply each electrical injector with a current, the time profile of which comprises a rapidly rising section up to a first holding value, a first oscillating amplitude section around the first holding value, a first falling section down to a second holding value, a second oscillating amplitude section around the second holding value and a second rapidly falling section down to a value of approximately zero.

As is indeed known, an electrical injector comprises an external body defining a cavity which communicates with the outside through an injection jet and in which there is accommodated an axially mobile pin to open and close the jet under the opposing axial thrusts of the pressure of the injected fuel, on the one hand, and of a spring and a rod, on the other, said rod being arranged along the axis of the plunger on the opposite side of the jet and being actuated by an electromagnetically driven metering valve.

During the initial opening phase of the electrical injector, not only must an appreciable force be exerted against the action of the spring, but the rod must be moved from the resting position to the actuation position in the fastest possible time. It is for this reason that the electromagnet excitation current in the initial phase is rather high (first holding value). The rapid rise in the current profile to the first holding value is necessary to ensure sufficient timing accuracy with regard to the moment of onset of actuation. Once the rod has reached the final position, however, the electrical injector still remains open with lower currents, hence the falling section and holding section around the second holding value in the electromagnet excitation current profile.

Said excitation current profile has in the past been obtained by using a drive device in which the electrical injectors were connected, on the one hand, directly to a supply line and, on the other, to a ground line through a controlled electronic switch.

However, said drive device exhibited the disadvantage that any short circuit to ground of one of the terminals of any of the electrical injectors, for example due to a loss of insulation on a cable conductor of the said electrical injectors and contact of said conductor with the motor vehicle's bodywork, resulted in permanent damage to the electrical injector itself and/or to the drive device, so causing the motor vehicle to shut down, which is highly hazardous when it is in motion.

In order to overcome this hazardous disadvantage, a drive device has been proposed in European Patent EP 0 924 589 in the name of the present applicant in which the electrical injectors are floating with regard to the supply lines, i.e. they are connected to the supply line and to the ground line through respective controlled electronic switches. In this manner, any short circuit to ground or to the supply of one of the terminals of the electrical injectors does not damage the electrical injector and thus does not cause the motor vehicle to shut down, but simply puts this single electrical injector out of service, the vehicle being capable of continuing in operation with one less electrical injector.

In the drive device described in the above-mentioned patent, the high voltage necessary to bring about the rapid rise in current in the initial opening phase of the electrical injector is generated by means of a boost circuit which raises the voltage supplied by the motor vehicle battery and substantially comprises a DC—DC converter.

It is also known that one of the approaches which is being pursued to improving the performance of and reducing the emissions from engines, in particular diesel engines equipped with a common rail fuel injection system, is that of increasing the fuel injection pressure, for example up to values of 1800 bar.

The most immediate consequence of this increase in pressure is an increase in the force exerted by the spring in order to counterbalance the pressure of the fuel and keep the electrical injector closed; it will consequently be necessary to exert a greater force on the rod of an electrical injector in order to overcome the action of the spring. In order to be able to increase the force exerted by the electromagnet, without having to change current levels, the number of turns and thus the inductance of the electromagnet is increased.

This results in an increase in the energy $E=\frac{1}{2}\cdot L\cdot I^2$ (and thus of the power) which must be supplied by the boost circuit during the initial control phase of the electrical injector, during which the current rises rapidly.

However, given that the DC—DC converter is dimensioned in accordance with the power which can be supplied to the electrical injector and, in particular, that the dimensions of the DC—DC converter increase as a function of the power it is desired to obtain from the output of the said DC—DC converter, raising the fuel injection pressure would entail the use of a DC—DC converter of considerably larger dimensions than that presently used, with a consequent increase in the area occupied by the DC—DC converter, the overall bulk of the drive device and the associated costs.

In order to overcome the problem associated with the overall bulk of the DC—DC converter and thus of the drive device for the electrical injectors, a voltage boost circuit has recently been developed which is made up of a single capacitor, the circuit being capable of recharging said capacitor using one or more electrical injectors which are non-operational, i.e. not involved in a fuel injection operation.

In particular, at the moment at which it is decided to recharge the capacitor of the voltage boost circuit, an electrical injector is first of all identified which at that moment is not involved in a fuel injection operation, electrical energy is then stored in said electrical injector and finally the stored electrical energy is transferred from the electrical injector to the capacitor of the voltage boost circuit.

The storage of electrical energy in one of the electrical injectors not involved in a fuel injection operation and the transfer of said stored energy to the capacitor of the voltage boost circuit are achieved by using the drive device shown in the example of FIG. 1, said device comprising a power circuit, designated 10 overall, which in turn comprises a plurality of drive circuits 11, one for each electrical injector 12; and a control circuit (not shown) for controlling operation of power circuit 10.

For simplicity's sake, FIG. 1 shows two drive circuits 11 associated with two respective electrical injectors 12 belonging to the same cylinder bank of the engine (not shown), each of which injectors is shown in the Figure with its corresponding equivalent circuit made up of a resistor and an inductor connected in series. Each drive circuit 11 comprises a first and a second input terminal 13, 14, connected to the positive pole and the negative pole of the motor vehicle's battery 23, said battery supplying a voltage $V_{BATT}$, the nominal value of which is typically 12 V; a third and a fourth input terminal 15, 16, connected to a first and a second output terminal of a boost circuit 8 which is common to all the drive circuits 11, between which it supplies a boosted voltage $V_{BOOST}$ greater than the battery voltage $V_{BATT}$, for example 50 V; and a first and a second output terminal 19, 20, between which is connected the associated electrical injector 12.

The terminal of each electrical injector 12 connected to the first output terminal 19 of the associated drive circuit 11 is typically known as the "high" or "hot" side terminal, while the terminal of each electrical injector 12 connected to the second output terminal 20 of the associated drive circuit 11 is typically known as the "low" or "cold" side terminal.

In its simplest embodiment, the boost circuit 8 is made up of a single, "boost" capacitor 21, connected between the first and the second output terminal of the boost circuit 8, and across which is connected a comparator stage with hysteresis 22 which outputs a logic signal which assumes a first logic level, for example high, when the voltage across the capacitor 21 is greater than a predetermined upper value, for example 50 V, and a second logic level, for example low, when the voltage across the capacitor 21 is less than a predetermined lower value, for example 49 V.

Each drive circuit 11 moreover comprises a ground line 24 connected to the second input terminal 14 and to the fourth input terminal 16, and a supply line 25 connected, on the one hand, to the first input terminal 13 through a first diode 26, the anode of which is connected to the first input terminal 13 and the cathode of which is connected to the supply line 25, and, on the other, to the third input terminal 15 through a first MOS transistor 27, which has the gate terminal capable of receiving a first control signal from the control circuit (not shown), a drain terminal connected to the third input terminal 15, and the source terminal connected to the supply line 25.

Each drive circuit 11 moreover comprises a second MOS transistor 28 having a gate terminal receiving a second control signal supplied by the control circuit (not shown), a drain terminal connected to the supply line 25, and a source terminal connected to the first output terminal 19; and a third MOS transistor 29 having a gate terminal receiving a third control signal supplied by the control circuit (not shown), a drain terminal connected to the second output terminal 20, and a source terminal connected to the ground line 24 through a sensing stage made up of a sense resistor 31 across which there is connected an operational amplifier 32 generating an output voltage $V_S$ proportional to the current flowing in said sense resistor 31.

Each drive circuit 11 moreover comprises a second, "free-wheeling" diode 33 with the anode connected to the ground line 24 and the cathode connected to the first output terminal 19; and a third, "boost" diode 34 with the anode connected to the second output terminal 20 and the cathode connected to the third input terminal 15.

The operation of each drive circuit 11 may be subdivided into three main distinct phases characterised by a different profile of the current flowing in the electrical injector 12: a first, rapid charging or "boost" phase, in which the current rises rapidly up to a holding value capable of opening the electrical injector 12; a second, holding phase, in which the current oscillates with a sawtooth profile around the value reached in the preceding phase; and a third, rapid discharge phase, in which the current falls rapidly from the value assumed in the preceding phase to a final value, which may also be zero.

In particular, in the rapid charging phase, the control circuit causes the transistors 27, 28 and 29 to close and the boosted voltage $V_{BOOST}$ is thus applied across the electrical injector 12. In this manner, the current flows in the network comprising the capacitor 21, the transistor 27, the transistor 28, the electrical injector 12, the transistor 29 and the sense resistor 31, rising over time in substantially linear manner with a gradient equal to $V_{BOOST}/L$ (where L represents the equivalent series inductance of the electrical injector 12). Since $V_{BOOST}$ is much higher than $V_{BATT}$, the current rises much more rapidly than could be achieved with $V_{BATT}$.

In the holding phase, transistor 29 is closed, transistor 27 is open and transistor 28 is repeatedly closed and opened and the battery voltage $V_{BATT}$ (when transistor 28 is closed) and a zero voltage (when transistor 28 is open) are thus applied alternately across the electrical injector 12. In the first case (transistor 28 closed), current flows in the network comprising the battery 23, the diode 26, the transistor 28, the electrical injector 12, the transistor 29 and the sense resistor 31, rising exponentially over time, while in the second case (transistor 28 open), current flows in the network comprising the electrical injector 12, the transistor 29, the sense resistor 31 and the free-wheeling diode 33, falling exponentially over time.

Finally, in the rapid discharge phase, the control circuit causes the transistors 27, 28 and 29 to open, so that, while current is passing through the electrical injector 12, the boosted voltage $-V_{BOOST}$ is applied across the electrical injector 12. In this manner, current flows in the network comprising the capacitor 21, the boost diode 34, the electrical injector 12 and the free-wheeling diode 33, falling over time in substantially linear manner with a gradient equal to $-V_{BOOST}/L$. Since $V_{BOOST}$ is much higher than $V_{BATT}$, the current falls much more rapidly than could be achieved with $V_{BATT}$. In this phase, the electrical energy stored in the electrical injector 12 (equal to $E=\frac{1}{2}\cdot L\cdot I^2$) is transferred to the capacitor 21, in such a manner as to allow the recovery of a proportion of the energy supplied by the drive circuit 11 during the rapid charging phase, so increasing the efficiency of the system. On the basis of calculations, it has been found that the percentage energy recovery associated with said phase may be at most around 25% (depending on the type of electrical injector, the materials used and the mechanical work performed by the electromagnet to move the rod).

Though widely used, the drive device described above has various drawbacks preventing it from being used to full advantage.

In particolar, the drive device described above fails to ensure correct synchronization of the control signals supplied to the transistors of drive circuits 11 during the three holding and control phases of the currents flowing through each of said electrical injectors. Moreover the control signals for the above-stated transistors 27, 28 and 29 are generated by the control circuit on the basis of operating parameters stored in a memory integral with the said control device.

These operating parameters are normally updated in line with any changes in the engine operating conditions and it could happen that the control signals are generated while the operating parameters are being updated, i.e. when only some of the operating parameters have been updated.

In this situation, the above-stated control signals would be generated on the basis of non-homogeneous operating parameters, i.e. which do not relate to a single set of engine operating conditions, and this may result in the electrical injectors being actuated in a manner which is inappropriate for current engine operating conditions.

SUMMARY OF THE INVENTION

It is an object of the present invention to provide a drive device for inductive electrical injectors, designed to ensure synchronization of the control signals supplied to each drive circuit during the three current holding and control phases, and to ensure homogenous operating parameters when generating the control signals.

According to the present invention, there is provided a drive device for electrical injectors of a common rail fuel injection system of an internal combustion engine comprising a power circuit having a drive circuit for each electrical injector; said drive circuit comprising switching means controlled selectively to regulate the current flowing through said electrical injector; said drive device also comprising a control circuit for controlling operation of each drive circuit of said power circuit, and being characterized in that said control circuit comprises:

a number of control modules, each for selectively controlling the switching means of a respective drive circuit, and supplying a state signal indicating the operating state of the control module; and synchronization means for receiving and processing said state signals to generate a common synchronization signal for synchronizing said control modules;

each said control module synchronizing and coordinating, as a function of said synchronization signal, the drive actions imparted to the switching means of the corresponding drive circuit with the drive actions imparted by the other control modules to the switching means of the respective drive circuits.

BRIEF DESCRIPTION OF THE DRAWINGS

A non-limiting embodiment of the present invention will be described by way of example with reference to the accompanying drawings, in which.

DETAILED DESCRIPTION OF THE PREFERRED EMBODIMENTS

Figure 2:
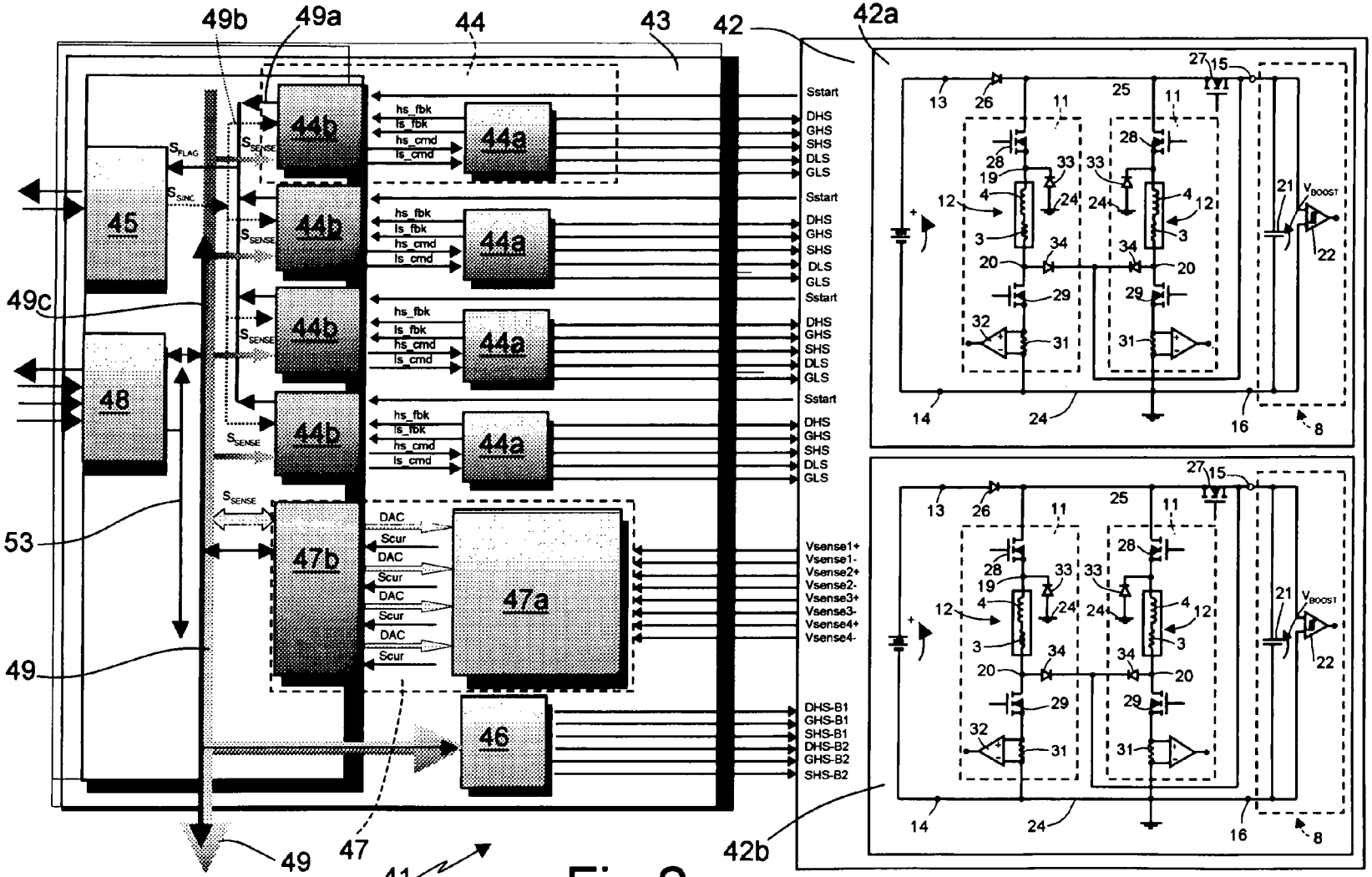
FIG. 2 shows a block diagram of a drive device for inductive electrical injectors in accordance with the teachings of the present invention.

Number 41 in FIG. 2 indicates as a whole a drive device for electrical injectors of a common rail fuel injection system of an internal combustion engine, which substantially comprises a power circuit 42 capable of supplying current to the electrical injectors, and a control circuit 43 capable of driving the power circuit 42 to regulate the current flowing through each electrical injector, in such a manner that, on the one hand, the current follows a predetermined profile over time, and on the other, the stored energy is transferred from an electrical injector to the capacitor of the voltage boost circuit (as described in detail previously).

Figure 1:
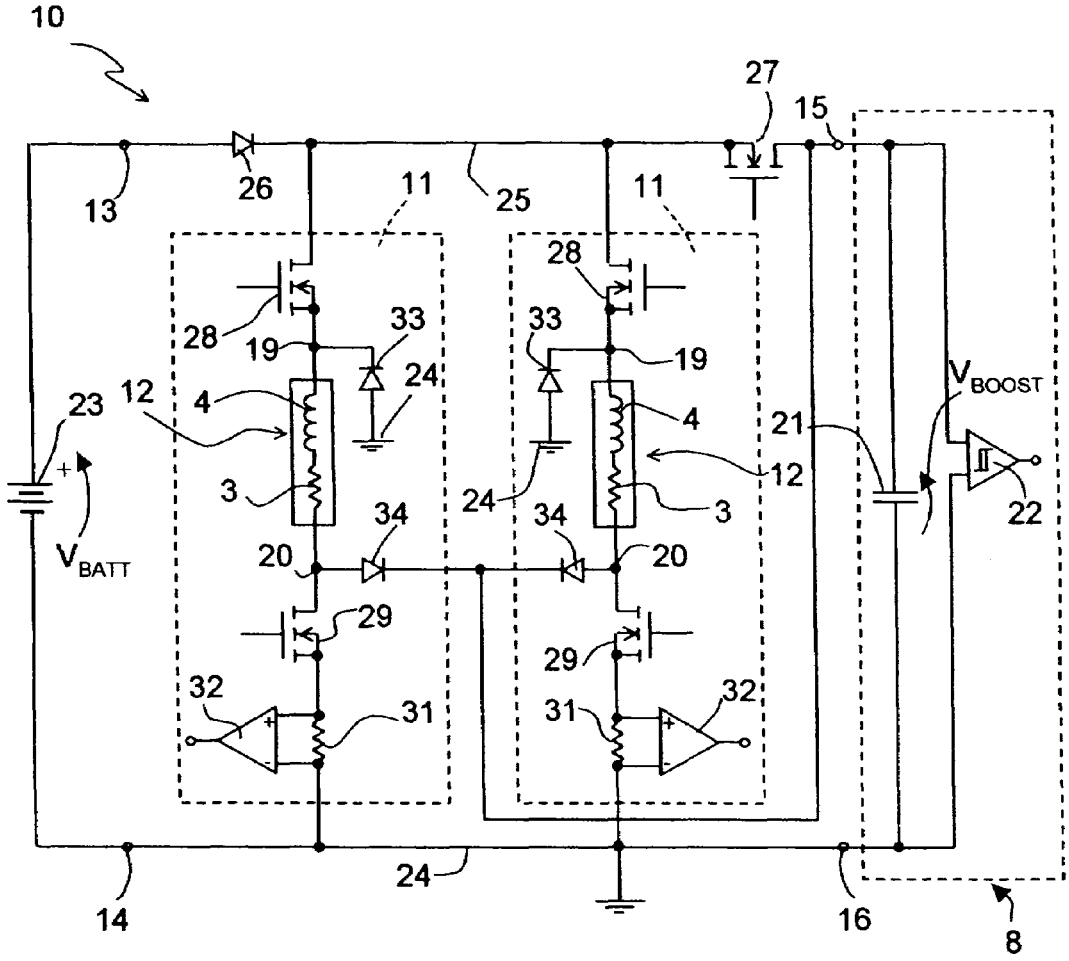
Fig. 1 Prior Art
FIG. 1 shows, schematically, a power circuit of a prior-art drive device.

The power circuit 42 shown schematically in the example of FIG. 2 is capable of controlling current in four electrical injectors, and comprises two power blocks 42*a*, 42*b*, each of which is made up of a circuit which is entirely similar to the power circuit 10 for controlling the two electrical injectors shown in FIG. 1, and consequently any elements in common with the power circuit 10 of FIG. 1 have been assigned the same reference numerals and will accordingly not be described in further detail.

The control circuit 43, however, is preferably defined by an ASIC-type integrated board (ASIC=Application Specific Integrated Circuit), the architecture or circuit structure of which is shown schematically in FIG. 2, which illustrates an example of a control circuit capable of driving the four drive circuits 11 of power circuit 42, to which the following description will make specific reference without consequently restricting the general scope thereof.

The control circuit 43 substantially comprises: four control blocks 44 (only one of which is shown with a dashed line), one for each electrical injector (i.e. one for each drive circuit 11), a synchronization block 45, a boost drive block 46, a current measurement block 47, and a communication block 48 for "interfacing" the control board or circuit 43 with one or more external control devices, in particular a main external microcontroller (not shown).

The various electrical blocks 43, 44, 45, 46, 47 and 48 stated above which make up the control circuit 43 are interconnected by means of a main control bus 49, this bus being the means not only for exchanging control signals between the blocks themselves but also for exchanging control signals between said blocks and the external control devices.

More specifically, the main control bus 49 comprises four state buses 49*a*, each connecting a relative control block 44 to synchronization block 45; a synchronization bus 49*b* for connecting synchronization block 45 to all the control blocks 44; and a communication bus 49*c* for exchanging control signals, data, or information between the above blocks and the external control devices.

Each control block 44 controls operation of a respective drive circuit 11 of an electrical injector 12, and checks, instant by instant, the operating state of drive circuit 11.

In detail, each control block 44 receives at its input a signal $S_{SENSE}$ indicating the value of the current flowing in the sense resistor 31 of the respective drive circuit 11; a feedback signal hs_fbk containing information relating to the operation of the second MOS transistor 28 (the controlled switch 28 present on the "high side" of the drive circuit 11); and a feedback signal ls_fbk containing information relating to the third MOS transistor 29 (the controlled switch 29 present on the "low side" of the drive circuit 11).

As stated, each control block 44 is connected to and supplied by synchronization bus 49*b* with a signal $S_{SINC}$ encoding information by which to enable control block 44 to synchronize the commands to be imparted to drive circuit 11 with those imparted by the other control blocks 44, in accordance with a predetermined drive strategy common to all the electrical injectors.

Each control block 44 also supplies at its output a control signal hs_cmd to the second MOS transistor 28, a control signal ls_cmd to the third MOS transistor 29, and a state signal $S_{FLAG}$, which contains information relating to the operating state of control block 44, and is transmitted by a respective state bus 49*a* to the synchronization block 45.

In fact, the control block 44 encodes in state signal $S_{FLAG}$ a number of control flags stored in a number of internal registers (not shown) in which information relating to the operating state of control block 44 is stored instant by instant.

As regards synchronization block 45, this is connected to the four state buses 49*a*, from which it receives the four corresponding state signals $S_{FLAG}$, and, in accordance with these, identifies the operating state of each control block 44, so that it can coordinate and synchronize, on the basis of the detected states, the electrical injector drive actions generated by control blocks 44.

In particular, the synchronization block 45 generates synchronization signal $S_{SINC}$ on the basis of the four state signals $S_{FLAG}$, and supplies it to the synchronization bus 49*b*, by which signal $S_{SINC}$ is supplied to the inputs of the four control blocks 44.

Each synchronization block 45 is also connected by an I/O port (not shown) to the communication bus 49*c*, by means of which it receives/transmits control signals from/to external control devices (not shown).

Figure 3:
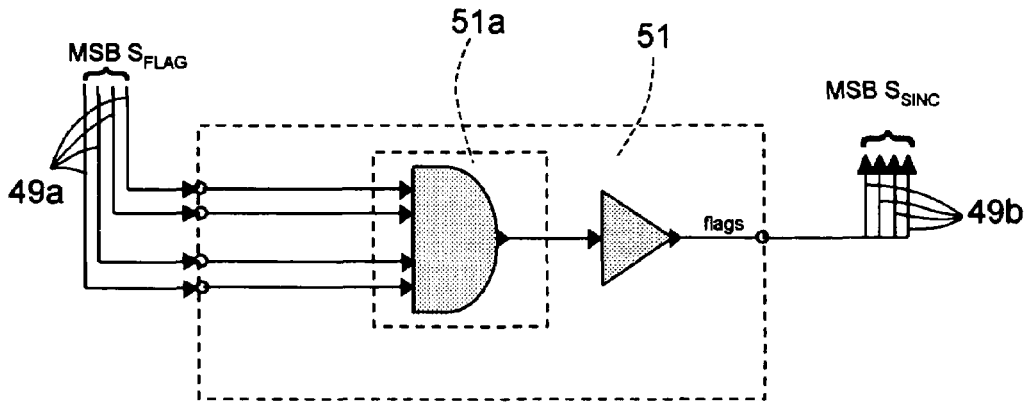
FIGS. 3 and 4 show, schematically, the circuit architecture of a first and second synchronization block, respectively, forming part of the FIG. 2 drive device.
Figure 4:
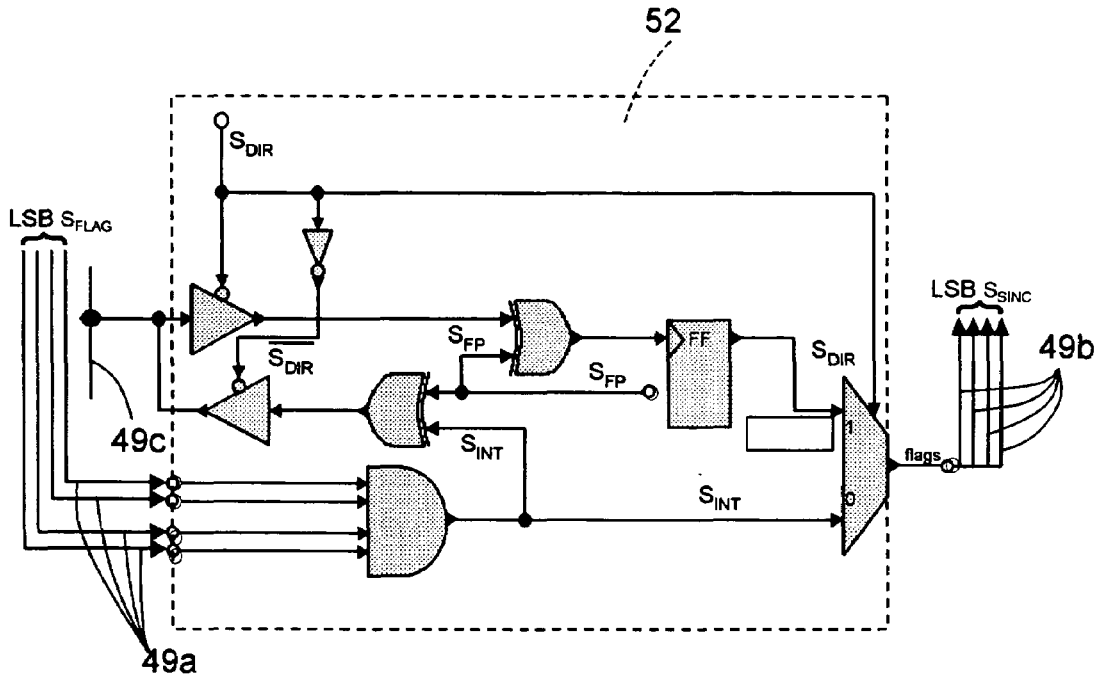

With reference to FIGS. 3 and 4 in particular, the synchronization block 45 comprises two synchronization logic stages, which implement a first set of logic operations on the most significant state bits (flags) of state signals $S_{FLAG}$, denoted below by the abbreviation MSB, and a second set of logic operations on the least significant state bits (flags) of state signals $S_{FLAG}$, denoted below by the abbreviation LSB.

In fact, each state signal $S_{FLAG}$ is encoded by the respective control block 44 in N bits, where N is preferably equal to 16, in which the first $N_1$=12 bits of each state signal $S_{FLAG}$ are considered MSBs (flags) and are supplied to the input of one of the two synchronization logic stages, referred to below as synchronization logic stage 51 (FIG. 3), while the remaining $N_2$=4 bits of each state signal $S_{FLAG}$ are considered LSBs (flags) and are supplied to the input of the other synchronization logic stage, referred to below as synchronization logic stage 52 (FIG. 4).

With reference to FIG. 3, the synchronization logic stage 51 comprises an AND circuit 51*a*, which has four inputs connected to the corresponding four state buses 49*a* to receive the MSBs (flags) of the four corresponding state signals $S_{FLAG}$, and an output connected to the synchronization bus 49*b* on which it supplies the MSBs (flags) of the synchronization signal $S_{SINC}$.

In detail, the AND circuit 51*a* has a number of AND logic gates (only one of which is shown schematically in FIG. 3), each of which implements the AND operation between the corresponding MSBs contained in the four state signals $S_{FLAG}$.

In other words, each logic gate executes the AND operation between the bits of the four state signals $S_{FLAG}$ occupying the same coding position within state signals $S_{FLAG}$. The synchronization logic stage 51 therefore supplies at its output, and transfers to the synchronization bus 49*b*, the 12 MSBs which make up the synchronization signal $S_{SINC}$, each of which is obtained by means of the AND operation executed between the four corresponding bits (flags) of the state signals $S_{FLAG}$.

With reference to FIG. 4, the input of the synchronization logic stage 52 is connected to the four state buses 49*a* to receive the LSBs (flags) of the four state signals $S_{FLAG}$, and its output is connected to the synchronization bus 49*b*, to which it supplies the 4 LSBs which, together with the 12 MSBs supplied at the output of the synchronization logic stage 51, make up the 16 bits defining signal $S_{SINC}$.

The synchronization logic stage 52 is also connected to the communication bus 49*c* to receive/transmit the control signals from/to the external devices and/or to the main external microcontroller (not shown), and can operate selectively, according to a command signal $S_{DIR}$, between a first and a second operating condition.

In fact, in the first operating condition, the synchronization logic stage 52 implements the logic AND between the corresponding LSBs (flags) of the four state signals $S_{FLAG}$ and supplies the 4 bits (flags) resulting from this operation both at its own output, thus completing the synchronization signal $S_{SINC}$, and to the communication bus 49*c*, overwriting the LSBs of the control signal.

In the second operating condition, on the other hand, the synchronization logic stage 52 supplies directly at its own output the 4 LSBs (flags) belonging to the control signal received on the communication bus 49*c*, thus overwriting the 4 LSBs (flags) of the synchronization signal $S_{SINC}$ with the respective 4 LSBs (flags) belonging to the control signal.

As shown more clearly in FIG. 4, the synchronization logic stage 52 comprises four identical logic circuits (only one of which is shown in FIG. 4), each of which can process the four LSBs occupying the same position in the respective four state signals $S_{FLAG}$.

Each logic circuit of the synchronization logic stage 52 preferably comprises an AND logic gate, a multiplexer, a pair of XOR (OR-exclusive) gates, two three-state gates, and a flip-flop.

In greater detail, the AND logic gate has four inputs, each of which receives an LSB of a respective state signal $S_{FLAG}$, and an output supplying a signal $S_{INT}$ encoding the bit obtained from the AND operation on the four input bits; and a first XOR gate has a first input connected to the output of the AND gate to receive the signal $S_{INT}$, a second input for receiving a signal $S_{FP}$ for switching the polarities of the bits, and an output connected to the communication bus 49*c* by means of a first three-state gate which can be activated by the negated command signal $S_{DIR}$.

The second XOR gate, on the other hand, has a first input connected to the communication bus 49*c* by means of the second three-state gate which can be activated by the command signal $S_{DIR}$, a second input receiving the signal $S_{FP}$, and an output connected to the input of the flip-flop. Finally, as regards the multiplexer, this has a first input connected to the output of the flip-flop, a second input connected to the output of the AND gate, an output connected to the synchronization bus 49*b*, and, finally, a third input receiving the command signal $S_{DIR}$ which selectively activates the connection between the output and one of the two inputs.

In the first operating condition, the negated command signal $S_{DIR}$ activates the first three-state gate which connects the output of the first XOR gate to the communication bus 49*c*, the multiplexer is activated and supplies at its own output the signal $S_{INT}$ available at the relative first input, while the command signal $S_{DIR}$ switches the second three-state gate to the high-impedance state.

In this case, therefore, the signal $S_{INT}$ resulting from the AND operation of the four LSBs of the four input signals $S_{FLAG}$ is supplied, on the one hand, to the output of the multiplexer to define one of the LSBs of the signal $S_{SINC}$, and, on the other hand, following the XOR logic operation (executed by the first XOR logic gate on the basis of the signal $S_{FP}$), to the communication bus 49*c*, in which one LSB of the control signal on communication bus 49*c* is overwritten.

In the second operating condition, on the other hand, the command signal $S_{DIR}$ activates the second three-state gate which connects the first input of the second XOR gate to the communication bus 49*c*, and the multiplexer is activated to supply at its output the signal supplied by the flip-flop.

The negated command signal $S_{DIR}$ switches the first three-state gate to the high impedance state, thus disabling the output of the first XOR gate and preventing transmission of the signal $S_{INT}$. In this case, one of the four LSBs (flags) of the control signal present in the communication bus 49*c* is received at the input of the second XOR gate, which, following the logic operation, supplies it to the flip-flop, which in turn supplies it through the multiplexer to the synchronization bus 49*b*, thus causing the overwriting of a corresponding LSB of the signal $S_{SINC}$.

In addition to the two synchronization logic stages 51 and 52 described above, the synchronization block 45 also has a number of internal configuration registers, for example: a register containing information relative to the polarity to be assigned to the flags, and as a function of which the signal $S_{FP}$ is generated; a register containing information relative to the read/write "direction" or route to be assigned to the flags, and on the basis of which is generated the command signal $S_{DIR}$ alternately controlling the two operating conditions of synchronization logic stage 52; and a register containing information relative to control of the configuration of the bits or flags associated with the current quantization thresholds assigned in the measurement block 47.

The synchronization block 45 also comprises a first configuration block (not shown), which stores an access mode to the data stored in the internal memories of the control blocks 44 (described in detail later on) by external devices, such as the main external microcontroller (not shown).

In the example shown, the first configuration block may be defined by a preferably two-bit register for coding three different data access modes, such as: a first access mode, in which the main external microcontroller, via communication block 48, directly accesses all the data stored in control block 44; and a second and third access mode, in which the main external microcontroller partly accesses the stored data according to a selective, alternate access mode (described in detail later on), with data access activated by control block 44.

Finally, the synchronization block 45 comprises a malfunction control block (not shown) for receiving interrupt request signals generated by control blocks 44 in the event a given malfunction condition of one or more of the electrical injectors is detected.

In fact, the malfunction control block receives from each control block 44 a relative interrupt request signal, and accordingly generates at its output a main interrupt signal, which is transmitted to the main external microcontroller, which accordingly identifies the control block(s) 44 diagnosing the malfunction.

Communication block 48 controls communication of information, i.e. data and signals, between the various blocks in control circuit 43 and the external control devices (not shown).

With reference to FIG. 2, communication block 48 is connected, on one side, to a data bus 53 and to main control bus 49 to transmit/receive data, signals and information to/from each block in control circuit 43, and is connectable, on the other side, to the external control devices, in particular the main external microcontroller (not shown) with which it exchanges control signals.

More specifically, the communication block 48 is preferably defined by a 16-bit communication interface (SPI interface) for implementing synchronous serial communication, and comprising a first control module (not shown) for managing communication requests relating to both read and write operations performed by the external control devices or the internal blocks; and a second control module (not shown) for implementing a communication protocol for managing data addressing in the various memories and/or internal registers of the blocks in control circuit 43, in the various read/write operations.

The measurement block 47 detects, for each electrical injector 12, the voltage $V_S$ supplied by the corresponding sensing stage of the control circuit 11, converts the analog signal of voltage $V_S$ to the digital signal $S_{SENSE}$ indicating the current flowing in the corresponding sense resistor 31, and, finally, supplies the latter to the respective control block 44.

More specifically, measurement block 47 substantially comprises an analog measurement stage 47*a*, which has a number of inputs, each receiving a signal indicating voltage $V_s$ and proportional to the voltage across a sense resistor 31 of drive circuit 11, and four outputs, each for supplying a signal $S_{CUR}$ indicating the value of the current flowing through a respective sense resistor 31.

As shown more clearly in the FIG. 2 example, analog measurement stage 47*a* has a number of input pins (indicated $V_{SENSE1+}$, $V_{SENSE1}$, . . . , $V_{SENSE4+}$, $V_{SENSE4-}$ in FIG. 2) connectable in pairs ($V_{SENSE1+}$, $V_{SENSE1-}$) to corresponding ends of a sense resistor 31 of a relative drive circuit 11 to determine its voltage $V_S$; and four outputs, each supplying analog current signal $S_{CUR}$.

Measurement block 47 also has a conversion circuit 47*b*, which is defined by a number of A/D conversion modules (not shown), and comprises four inputs, each of which receives signal $S_{CUR}$ supplied by analog circuit 47*a*, and a number of input/output ports connected to main control bus 49 to receive and transmit data and/or signals from/to the other blocks in control circuit 43.

More specifically, analog/digital conversion circuit 47*b* transmits the four signals $S_{SENCE}$ to the four respective control blocks 44 over main control bus 49, and receives from main control bus 49 signals $S_{DAC}$ for setting the current quantization threshold levels in the comparators of analog circuit 47*a*.

With reference to FIG. 2, boost control block 46 controls the first MOS transistor 27 of drive device 41 to control activation of the boost device.

In the FIG. 2 example, boost control block 46 controls two boost devices present in the two respective control blocks 42*a*, 42*b* and each connected to the two corresponding drive circuits 11.

More specifically, boost control block 46 is input-connected to communication bus 49*c* to receive, for each boost device, a respective control signal of first MOS transistor 27, and comprises a number of input pins, indicated DHS-B1, GHS-B1, SHS-B1, DHS-B2, GHS-B2, SHS-B2 in the example shown, which are connected respectively to the drain, gate, and source terminals of the two first MOS transistors 27.

Boost control block 46 controls each first MOS transistor 27 as a function of the incoming control signals, and supplies a relative bias voltage value at each pin DHS-B1, GHS-B1, SHS-B1, DHS-B2, GHS-B2, SHS-B2.

With reference to FIG. 2, each control block 44, as stated, selectively controls the second MOS transistor 28 on the "high side", and the third MOS transistor 29 on the "low side" of each of the four drive circuits 11, so as to control the current flowing in electrical injectors 12, and at the same time diagnoses correct operation of electrical injectors 12.

More specifically, in the FIG. 2 example, each control block 44 comprises a pair of control stages, of which a first control stage, hereinafter indicated 44*a*, is defined by an analog circuit connected directly to a corresponding control circuit 11, while the second control stage, hereinafter indicated 44*b*, is connected, on the one hand, to the main control bus 49, and, on the other, to the first control stage 44*a*, to which it supplies the control signal hs_cmd of the second MOS transistor 28 and the control signal ls_cmd of the third MOS transistor 29.

With reference to FIG. 2, the first control stage 44*a* has a number of output pins or terminals connected to the terminals of the second and third MOS transistor 28 and 29 to supply these with bias voltages generated as a function of the control signals hs_cmd and ls_cmd.

More specifically, a first, second and third pin, indicated DHS, GHS and SHS in FIG. 2, are connected to the respective drain, gate and source terminals of the second MOS transistor 29, while the fourth and fifth pin, respectively indicated DLS, GLS, are connected to the corresponding drain and gate terminals of the second MOS transistor 29.

The first control stage 44*a* also has a "high side" monotoring circuit and a "low side" monitoring circuit (not shown), which supply the second control stage 44*b* with respective feedback signals hs_fbk and ls_fbk encoding information relating to operation of the second and third MOS transistors 28 and 29.

The second control stage 44*b*, on the other hand, receives the feedback signals hs_fbk and ls_fbk from the first control stage 44*a*, and the synchronization signal $S_{SINC}$, and supplies the state signal $S_{FLAG}$ and the control signals hs_cmd and ls_cmd.

It should be noted that the second control stage 44*b* also supplies, as a function of the feedback signals hs_fbk and ls_fbk, the interrupt request signal to the main external microcontroller, and a signal encoding a series of data generated by a request transmitted from the main external microcontroller, and signal $S_{DAC}$ for setting the current quantization threshold levels in the comparators of the analog circuit 47*a*.

Figure 5:
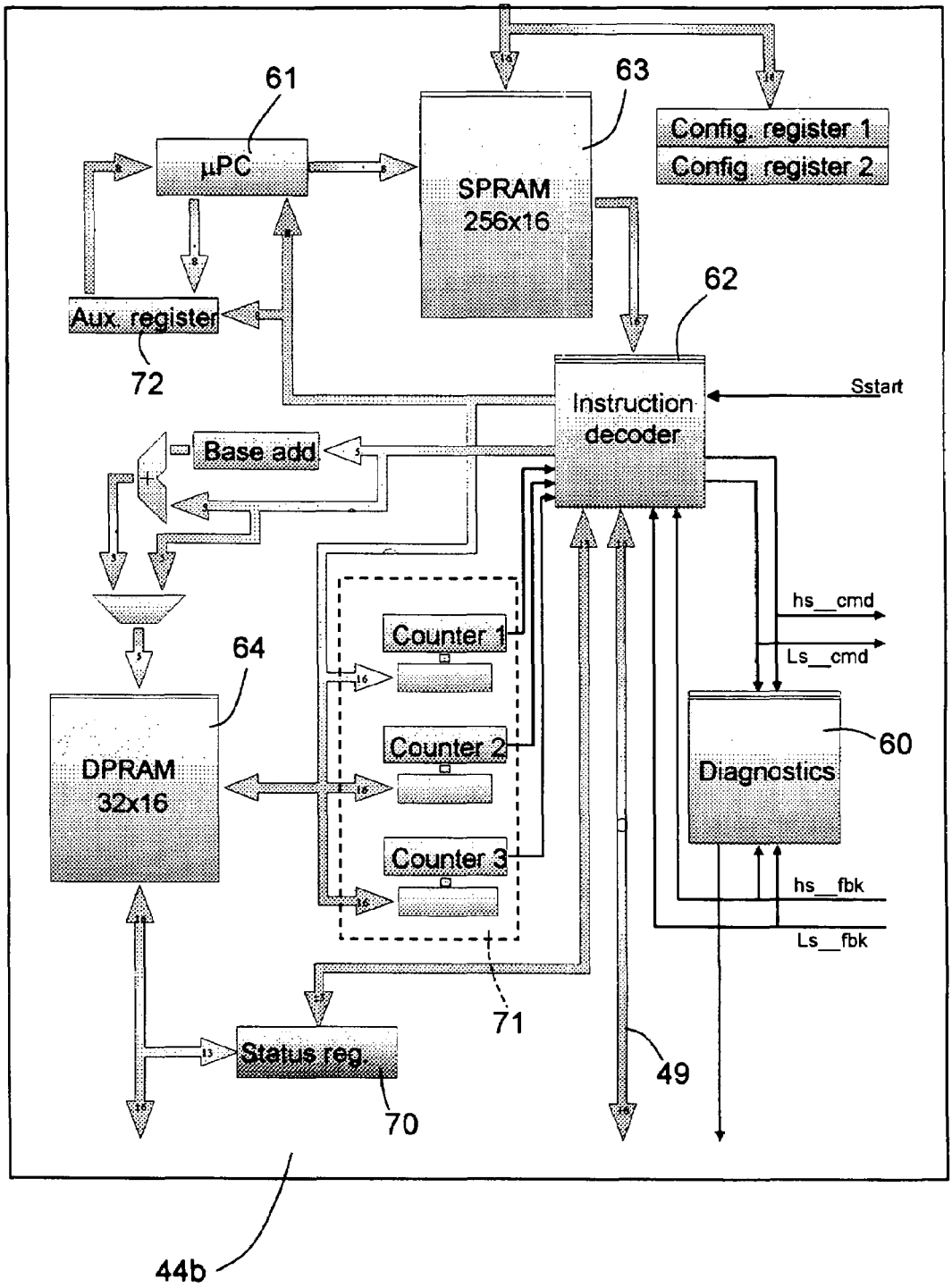
FIG. 5 shows the circuit architecture of a control stage forming part of a control block of the electrical injectors in FIG. 2.

FIG. 5 shows an example of the circuit architecture of the second control stage 44*b*, which substantially comprises a diagnostic block 60, a first counter block 61, an internal microcontroller 62, a main memory 63, and a secondary memory 64 storing a number of operatine parameters characterizing operation of the engine (not shown).

The diagnostic block 60 performs an instantaneous comparison of the control signals hs_cmd and ls_cmd supplied to drive circuit 11, and the incoming feedback signals hs_fbk and ls_fbk, in such a manner as to detect any error conditions and accordingly generate the interrupt request signal to the internal microcontroller 62 or to the main external microcontroller.

The main memory 63 stores the programming code containing the various instructions to be implemented in the internal microcontroller 62, and is defined by a RAM memory block (256×16) which cooperates with the first counter block 61 and stores, instant by instant, the address of the instruction to be supplied to the internal microcontroller 62.

The secondary memory block 64 "interfaces" the internal microcontroller 62 with the main external microcontroller, and stores a number of engine operating parameters, on the basis of which the internal microcontroller 62 generates control signals hs_cmd and ls_cmd of the respective electrical injector 12.

The operating parameters stored in secondary memory 64 are accessible by the main external microcontroller as a function of the selected access mode, which, as stated, may correspond alternatively to the first, second or third data access mode.

In the example shown, when the access configuration to secondary memory 64 assigned to control block 44 corresponds to the second access mode, secondary memory 64 is divided into two memory areas alternatively read/write accessible by internal microcontroller 62 and the main external microcontroller respectively.

More specifically, at this operating phase, a number of pointer registers 71, forming part of control stage 44*b*, cooperate with the internal microcontroller 62 and the main external microcontroller to determine access by the internal microcontroller 62 to one memory area and, simultaneously, access by the main external microcontroller to the other memory area, and, on command, swap access by the internal microcontroller 62 and the main external microcontroller to the two memory areas.

In other words, read/write access to the secondary memory 64 is organized in such a manner that, when the internal microcontroller 62 accesses one of the two memory areas to read the operating parameters to be used in the ongoing control operation of the electrical injector, the main external microcontroller can only access the other memory area to write (reprogram or update) the operating parameters to be used by the internal microcontroller 62 in the control operation of electrical injector 12 following the one in progress. Obviously, the pointer registers 71 alternately address the memory area accessible by the main external microcontroller and the memory area accessible by the internal microcontroller 62.

Figure 6:
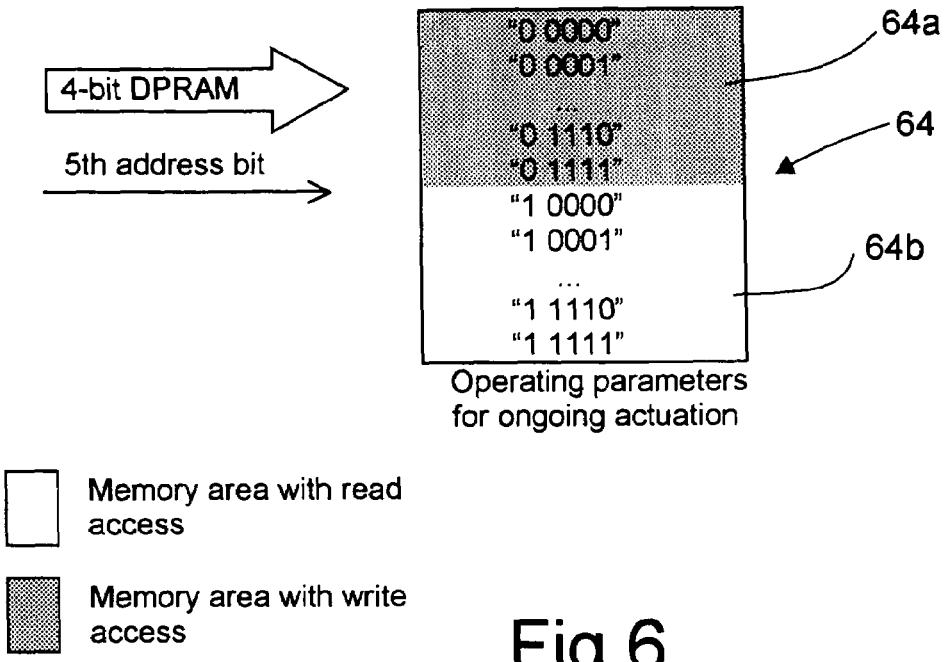
FIGS. 6 and 7 show, schematically, access modes to the data stored in a memory forming part of the drive device, in two consecutive operating conditions.
Figure 7:
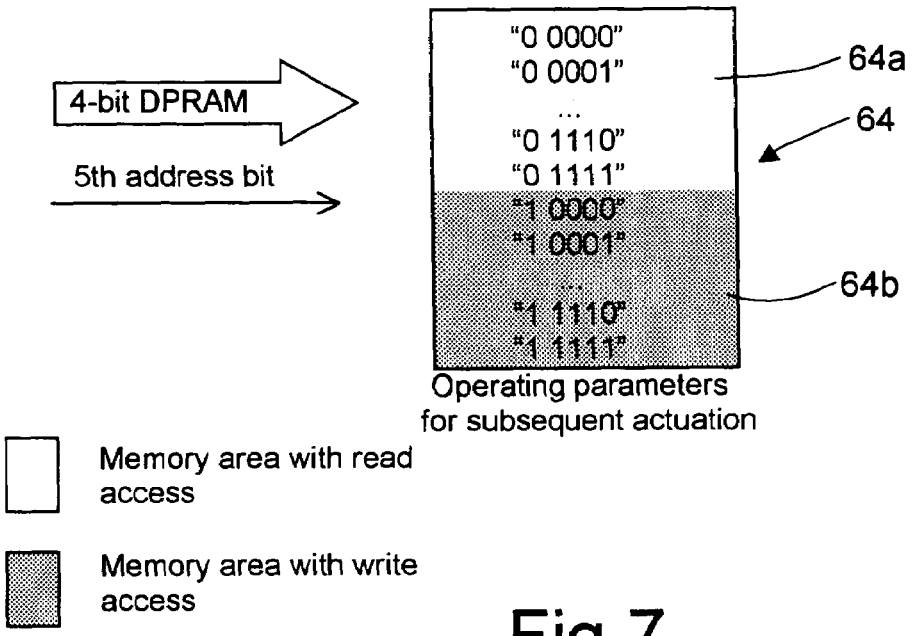

FIGS. 6 and 7 illustrate schematically the division and organization of secondary memory 64 into the two memory areas in two consecutive operating phases, in which, in a first phase (FIG. 6), the pointer registers 71 address a first memory area 64*a* (highlighted in grey) to the internal microcontroller 62, and a second memory area 64*b* to the main external microcontroller, and, in a second phase, the pointer registers 71 swap access, i.e. address the second memory area 64*b* (highlighted in grey) to internal microntroller 62, and the first memory area 64*a* to the main external microcontroller.

More specifically, in the first operating phase, the first memory area 64*a* is thus only write-accessible by the main external microcontroller, which overwrites and/or reprograms the operating parameters, while the second memory area 46*b* (not highlighted) is only read-accessible by the internal microcontroller 62, which accesses the operating parameters stored in it to generate control signals hs_cmd and ls_cmd accordingly.

In the second operating phase, access to first and second memory areas 64*a* and 64*b* is swapped, after which the first memory area 64*a* (not highlighted) becomes exclusively accessible by the internal microcontroller 62, which uses the previously modified operating parameters to control the latest actuation of electrical injector 12, while the second memory area 64*b* becomes exclusively accessible by the main external microcontroller, which reprograms the operating parameters contained in it.

Access swapping between pointer registers 71, i.e. passage from one operating phase to the other, may be performed upon control block 44 receiving a signal $S_{START}$ indicating further actuation of electrical injector 12, and/or when the main external microcontroller completes updating of the operating parameters in the write-assigned memory area.

In connection with the above, it should be pointed out that, in the second access mode, swapping access to the two memory areas of the secondary memory 64 eliminates any data write/read conflict between the internal microcontroller 62 and the main external microcontroller, and advantageously permits a double buffer configuration in which the main external microcontroller can program the "new" operating parameters for the next actuation control operation, while the "old" operating parameters remain unchanged, stable and available to the internal microcontroller 62 throughout the ongoing actuation control operation.

Obviously, in this phase, the access addresses to the first and second memory areas 64*a*, 64*b* are temporarily stored in the respective pointer registers 71, of which a first pointer register (not shown) supplies the internal microcontroller 62 with the address of the read-only memory area, and a second pointer register supplies the main external microcontroller with the address of the write-only memory area.

The secondary memory 64 is preferably defined by a (32×16) DPRAM (Dual Port RAM) module comprising two memory blocks, each of which stores 16 words, and is connected to an address bus defined by 5 address lines in which four bits are used to address the words, and a fifth bit is used to define access to the two memory blocks by the internal microcontroller 62 and the main external microcontroller.

In connection with the above, it should be pointed out that, in the first access mode, secondary memory 64 is so organized that the two memory blocks, i.e. the 32 memory locations, are fully accessible by the main external microcontroller. As for the third access mode, this is identical with the second access mode, except that the fifth address bit is only supplied at the end of a write operation.

With reference to FIG. 5, the second control stage 44*b* also comprises a number of first registers 70 used when writing/reading data in the secondary memory 64; a multiplexer block (not shown) for selecting the data to be stored in the first registers 70; and a second, preferably 8-bit, register (not shown) for storing the current quantization thresholds of the measurement block.

The second control stage 44*b* also comprises a register control block (not shown) cooperating with the first counter block 61 to control direct jumps, conditional jumps, execution of sub-instructions, and standby states; and an auxiliary register 72 used as an auxiliary storage element when managing coded instructions in main memory 63, e.g. when executing conditional or direct jump instructions.

The internal microcontroller 62 receives instructions from the main memory 63, decodes them and executes them in such a manner as to generate control signals hs_cmd and ls_cmd.

In particular, with reference to FIG. 5, the internal microcontroller 62 receives a signal $S_{START}$ to start actuation of the electrical injector, and the feedback signals hs_fbk and ls_fbk, supplies control signals hs_cmd and ls_cmd, and is connected to the main control bus 49 to exchange the control signals.

Operation of drive device 41 is readily deducible from the above description, with no further explanation required.

Electrical injector drive device 41 is extremely advantageous by coordinating control of the electrical injectors by the respective control blocks, thus ensuring correct synchronized actuation of the electrical injectors in the three current holding and control phases.

Moreover, the drive device cooperates with the external microcontroller in an operating mode ensuring no conflict between the main external microcontroller and the internal microcontroller.

Clearly, changes may be made to the drive device as described and illustrated herein without, however, departing from the scope of the present invention.

The invention claimed is:

1. A drive device (41) for electrical injectors of a common rail fuel injection system of an internal combustion engine, comprising a power circuit (42) having a drive circuit (11) for each electrical injector (12); said drive circuit (11) comprising switching means (27, 28, 29) controlled selectively to regulate the current flowing through said electrical injector (12); said drive device also comprising a control circuit (43) for controlling operation of each drive circuit (11) of said power circuit (42), and being characterized in that said control circuit (43) comprises:

a number of control modules (44), each for selectively controlling the switching means (27, 28, 29) of a respective drive circuit (11), and supplying a state signal ($S_{FLAG}$) indicating the operating state of the control module (44); and synchronization means (45) for receiving and processing said state signals ($S_{FLAG}$) to generate a common synchronization signal ($S_{SINC}$) for synhcronizing said control modules (44);

each said control module (44) synchronizing and coordinating, as a function of said synchronization signal ($S_{SINC}$), the drive actions imparted to the switching means (27, 28, 29) of the corresponding drive circuit (11), with the drive actions imparted by the other control modules (44) to the switching means (27, 28, 29) of the respective drive circuits (11).

2. A drive device as claimed in claim 1, characterized in that said control circuit (43) comprises communication means (49) for communicating the state signals ($S_{FLAG}$) supplied by said control modules (44) to said synchronization means (45); said communication means (49) communicating to each said control module (44) the synchronization signal ($S_{SINC}$) generated by said synchronization means (45).

3. A drive device as claimed in claim 2, characterized in that said communication means (49) comprise a number of state buses (49*a*), each for communicating to said synchronization means (45) a relative state signal ($S_{FLAG}$) supplied by a respective control module (44); and at least one synchronization bus (49*b*) for communicating to said control modules (44) said synchronization signal ($S_{SINC}$) generated by said synchronization means (45).

4. A drive device as claimed in claim 1, characterized in that each state signal ($S_{FLAG}$) codes a number of bits-flags associated with the operating state of the respective control module (44); and in that said synchronization means (45) comprise logic operator means (51, 52) for generating the synchronization signal ($S_{SINC}$) by performing a first series of logic operations on a first set of bits-flags of said state signals ($S_{FLAG}$), and a second series of logic operations on the remaining bits-flags of said state signals ($S_{FLAG}$).

5. A drive device as claimed in claim 4, characterized in that said logic operator means (51, 52) comprise a first AND logic circuit (51*a*), which has a number of inputs connected to said state buses (49*a*) to receive the most significant bits-flags (MSB) of the corresponding state signals ($S_{FLAG}$), and at least one output connected to said synchronization bus (49*b*) to supply the most significant bits-flags (MSB) of said synchronization signal ($S_{SINC}$); each of said most significant bits-flags (MSB) of said synchronization signal ($S_{SINC}$) being generated by said first AND logic circuit (51*a*) by performing the AND logic operation on said most significant bits-flags (MSB) of the corresponding state signals ($S_{FLAG}$).

6. A drive device as claimed in claim 4, characterized in that said logic operator means (51, 52) comprise a second AND logic circuit (52), which has a number of inputs connected to said state buses (49*a*) to receive the least significant bits-flags (LSB) of the corresponding state signals ($S_{FLAG}$), and at least one output connected to said synchronization bus (49*b*) to which it supplies the least significant bits-flags (LSB) of said synchronization signal ($S_{SINC}$), and a communication port connectable to a communication bus (49*c*) to receive/transmit a control signal from/to external control means.

7. A drive device as claimed in claim 6, characterized in that said second AND logic circuit (52) operates, on command, between a first operating condition in which it generates the least significant bits-flags (LSB) of the synhronization signal ($S_{SINC}$) as a function of the least significant bits-flags (LSB) of said state signals ($S_{FLAG}$), and a second operating condition in which it generates the least significant bits-flags (LSB) of the synchronization signal ($S_{SINC}$) as a function of the bits-flags of the control signal received on said communication bus (49*c*).

8. A drive device as claimed in claim 7, characterized in that said second AND logic circuit (52), in the first operating condition, performs an AND logic operation on said least significant bits-flags (LSB) of said state signals ($S_{FLAG}$).

9. A drive device as claimed in claim 8, characterized in that said second AND logic circuit (52), in said first operating condition, modifies said control signal on said communication bus (49*c*) as a function of said least significant bits-flags (LSB) of said state signals ($S_{FLAG}$).

10. A drive device as claimed in claim 1, characterized in that each said control module (44) comprises memory means (64) having at least two memory areas (64*a*, 64*b*), each storing the same operating parameters for said drive circuits (11); reading means (62) for reading the operating parameters; and pointer means (71) cooperating with said reading means (62) and with writing means for writing the operating parameters, to determine access by said writing means to one of said memory areas (64*a*, 64*b*), and, simultaneously, access by said reading means (62) to the other of said memory areas (64*a*, 64*b*); said pointer means (71) swapping access by said writing means and by said reading means (62) to said memory areas (64*a*, 64*b*).

11. A drive device as claimed in claim 10, characterized in that said pointer means (71) swap access to the memory areas (64*a*, 64*b*) when said writing means complete updating said operating parameters in one of said memory areas (64*a*, 64*b*), and/or at each new actuation to be commanded to the respective electrical injector (12).

12. A drive device as claimed in claim 1, characterized in that said control circuit (43) comprises communication means (48) for controlling communication of information between said control circuit (43) and external control means.

13. A drive device as claimed in claim 1, characterized in that said control circuit (43) comprises measurement means (47) for determining, for each said electrical injector (12), the current flowing through the electric injector (12).

14. A drive device as claimed in claim 1, wherein said power circuit (42) comprises at least one boost device, and said switching means (27, 28, 29) comprise at least a first transistor (27) activated selectively to connect said boost device to said drive circuits (11) in said power circuit (42); said control circuit (43) comprising boost drive means (46) for controlling said first transistor (27) in such a manner as to control activation of said boost device.

15. A drive device as claimed in claim 3, wherein said switching means (27, 28, 29) of each said drive circuit (11) comprise a second and third transistor (28, 29) activated selectively to regulate current flow in the corresponding electrical injector (12); said drive device (41) being characterized in that each said control module (44) is connected on one side to said communication bus (49*a*), to said state bus (49*a*), and to said synchronization bus (49*b*), and on the other side to the respective drive circuit (11), to which is supplies a first and a second control signal (hs_cmd, ls_cmd) to control the second and third transistor (28, 29) of the drive circuit (11) respectively.

16. A drive device as claimed in claim 1, characterized in that said control circuit (43) is defined by an ASIC integrated board.

* * * * *